US006386208B1

(12) United States Patent
Reid

(10) Patent No.: US 6,386,208 B1
(45) Date of Patent: May 14, 2002

(54) HAIR ACCESSORY AND BINDING DEVICE

(76) Inventor: Alice M. Reid, 1920 Putnam Dr., Reno, NV (US) 89503

( * ) Notice: Subject to any disclaimer, the term of this patent is extended or adjusted under 35 U.S.C. 154(b) by 0 days.

(21) Appl. No.: 09/965,730

(22) Filed: Sep. 27, 2001

(51) Int. Cl.[7] ..... A45D 8/12; A45D 2/00; A45D 2/14

(52) U.S. Cl. ..... 132/275; 132/245; 132/248

(58) Field of Search ..... 132/275, 246, 132/278, 280, 245, 248, 249, 251, 254, 257, 259, 260, 273

(56) References Cited

U.S. PATENT DOCUMENTS

| | | | | | |
|---|---|---|---|---|---|
| D153,831 | S | | 5/1949 | Solomon | |
| 3,192,932 | A | | 7/1965 | Hart | |
| 3,817,260 | A | | 6/1974 | Kleine | |
| 3,881,501 | A | | 5/1975 | Kleine | |
| 4,224,955 | A | * | 9/1980 | Meyerhoefer et al. | 132/248 |
| 4,406,296 | A | | 9/1983 | Wexler et al. | |
| 4,856,542 | A | * | 8/1989 | Hollenberg et al. | 132/265 |
| D318,540 | S | | 7/1991 | Carter | |
| 5,062,436 | A | | 11/1991 | Emsellem | |
| 5,154,196 | A | | 10/1992 | Moffat | |
| 5,316,021 | A | * | 5/1994 | Giordano | 132/248 |
| D362,318 | S | | 9/1995 | Corroher | |
| 5,740,820 | A | * | 4/1998 | Stern | 132/249 |
| 5,813,419 | A | * | 9/1998 | Brams | 132/222 |
| 5,833,335 | A | * | 11/1998 | Voughlohn | 132/273 |
| 5,979,465 | A | * | 11/1999 | Marrese et al. | 132/248 |
| 6,003,522 | A | | 12/1999 | Schach | |

* cited by examiner

*Primary Examiner*—John J. Wilson
*Assistant Examiner*—Robyn Kieu Doan

(57) ABSTRACT

A hair accessory and binding device for holding hair in a bound manner includes a first panel having a first end edge, a second end edge, a top surface and a bottom surface. A second panel is elongated and has a first end and a second end. The first end of the second panel is integrally attached to the bottom surface adjacent to the first end edge. The second panel generally extends toward the second end edge. A tab angled toward the first end edge is attached to the second end edge. The tab has an aperture therein. A catch is attached to the first panel adjacent to the first end edge. A pin is extendable through the tab and through the catch. An elongate flexible member has a first end attached to the first end edge and a second end attached to an end of the pin.

7 Claims, 1 Drawing Sheet

HAIR ACCESSORY AND BINDING DEVICE

BACKGROUND OF THE INVENTION

1. Field of the Invention

The present invention relates to barrette devices and more a particularly pertains to a new hair accessory and binding device for holding hair in a bound manner.

2. Description of the Prior Art

The use of barrette devices is known in the prior art. More specifically, barrette devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,154,196; U.S. U.S. Pat. No. 5,062,436; U.S. Pat. No. 4,406,296; U.S. Pat. No. 3,881,501; U.S. Pat. No. 3,817,260; U.S. Des. Pat. No. 362,318; and U.S. Pat. No. 6,003,522; U.S. Des. Pat. No. 318,540; U.S. Pat. No. 3,192,932; U.S. Des. Pat. No. 153, 831.

While these devices fulfill their respective, particular objectives and requirements, the aforementioned patents do not disclose a new hair accessory and binding device. The inventive device includes a first panel which is elongated and has a first end edge, a second end edge, a first side edge, a second side edge a top surface and a bottom surface. A second panel is elongated and has a first end and a second end. The first end of the second panel is integrally attached to the bottom surface of the first panel and is positioned adjacent to the first end edge. The second panel generally extends toward the second end edge of the first panel. Each of the first and second panels is resiliently elastic such that the second panel may be brought in abutment with the first panel. A tab is attached to the second end edge of the first panel and is angled toward the first end of the first panel such that the tab extends downward with respect to the top surface. The tab has an aperture therein. The second end of the second panel is placed between the tab and the first panel such that the second panel is biased against the tab and the hair of the user is bound in between the first and second panels. A catch is attached to the first panel and is positioned generally adjacent to the first end edge. An elongate flexible member has a first end attached to the first end edge and a second end attached to an end of a pin. Hair is wrapped about the hair between the panels toward the scalp and defining a French roll and the pin may be extended through the aperture in the tab and through the catch such that the elongate flexible member extends around the French roll for securing the French roll taut.

In these respects, the hair accessory and binding device according to the present invention substantially departs from the conventional concepts and designs of the prior art, and in so doing provides an apparatus primarily developed for the purpose of holding hair in a bound manner.

SUMMARY OF THE INVENTION

In view of the foregoing disadvantages inherent in the known types of barrette devices now present in the prior art, the present invention provides a new hair accessory and binding device construction wherein the same can be utilized for holding hair in a bound manner.

The general purpose of the present invention, which will be described subsequently in greater detail, is to provide a new hair accessory and binding device apparatus and method which has many of the advantages of the barrette devices mentioned heretofore and many novel features that result in a new hair accessory and binding device which is not anticipated, rendered obvious, suggested, or even implied by any of the prior art barrette devices, either alone or in any combination thereof.

To attain this, the present invention generally comprises a first panel which is elongated and has a first end edge, a second end edge, a first side edge, a second side edge a top surface and a bottom surface. A second panel is elongated and has a first end and a second end. The first end of the second panel is integrally attached to the bottom surface of the first panel and is positioned adjacent to the first end edge. The second panel generally extends toward the second end edge of the first panel. Each of the first and second panels is resiliently elastic such that the second panel may be brought in abutment with the first panel. A tab is attached to the second end edge of the first panel and is angled toward the first end of the first panel such that the tab extends downward with respect to the top surface. The tab has an aperture therein. The second end of the second panel is placed between the tab and the first panel such that the second panel is biased against the tab and the hair of the user is bound in between the first and second panels. A catch is attached to the first panel and is positioned generally adjacent to the first end edge. An elongate flexible member has a first end attached to the first end edge and a second end attached to an end of a pin. Hair is wrapped about the hair between the panels toward the scalp and defining a French roll and the pin may be extended through the aperture in the tab and through the catch such that the elongate flexible member extends around the French roll for securing the French roll taut.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair accessory and binding device apparatus and method which has many of the advantages of the barrette devices mentioned heretofore and many novel features that result in a new hair accessory and binding device which is not anticipated, rendered obvious, suggested, or even implied by any of the prior art barrette devices, either alone or in any combination thereof.

It is another object of the present invention to provide a new hair accessory and binding device which may be easily and efficiently manufactured and marketed.

It is a further object of the present invention to provide a new hair accessory and binding device which is of a durable and reliable construction.

An even further object of the present invention is to provide a new hair accessory and binding device which is susceptible of a low cost of manufacture with regard to both materials and labor, and which accordingly is then susceptible of low prices of sale to the consuming public, thereby making such hair accessory and binding device economically available to the buying public.

Still yet another object of the present invention is to provide a new hair accessory and binding device which provides in the apparatuses and methods of the prior art some of the advantages thereof, while simultaneously overcoming some of the disadvantages normally associated therewith.

Still another object of the present invention is to provide a new hair accessory and binding device for holding hair in a bound manner.

Yet another object of the present invention is to provide a new hair accessory and binding device which includes a first panel which is elongated and has a first end edge, a second end edge, a first side edge, a second side edge a top surface and a bottom surface. A second panel is elongated and has a first end and a second end. The first end of the second panel is integrally attached to the bottom surface of the first panel and is positioned adjacent to the first end edge. The second panel generally extends toward the second end edge of the first panel. Each of the first and second panels is resiliently elastic such that the second panel may be brought in abutment with the first panel. A tab is attached to the second end edge of the first panel and is angled toward the first end of the first panel such that the tab extends downward with respect to the top surface. The tab has an aperture therein. The second end of the second panel is placed between the tab and the first panel such that the second panel is biased against the tab and the hair of the user is bound in between the first and second panels. A catch is attached to the first panel and is positioned generally adjacent to the first end edge. An elongate flexible member has a first end attached to the first end edge and a second end attached to an end of a pin. Hair is wrapped about the hair between the panels toward the scalp and defining a French roll and the pin may be extended through the aperture in the tab and through the catch such that the elongate flexible member extends around the French roll for securing the French roll taut.

Still yet another object of the present invention is to provide a new hair accessory and binding device that allows a person to easily create a French roll in their hair by binding their hair in a barrette type device and winding the barrette toward the head such that a pin may be extending through the device for holding an elongated flexible member around the hair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
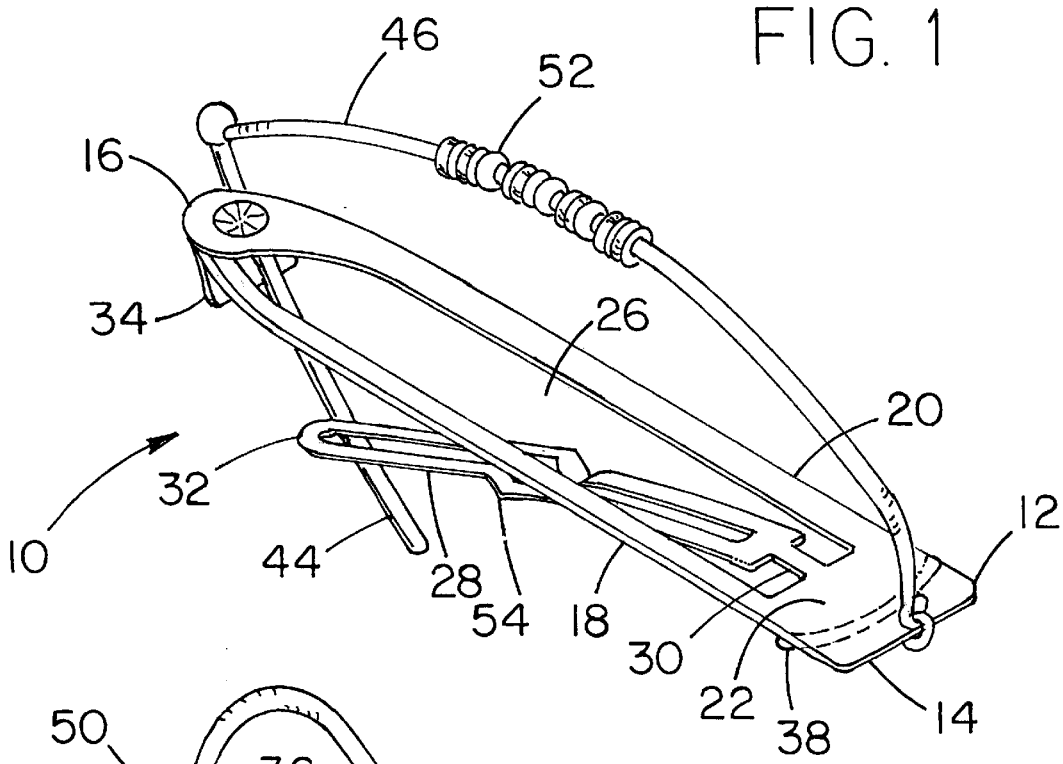
FIG. 1 is a schematic perspective top view of a new hair accessory and binding device according to the present invention.
Figure 2:
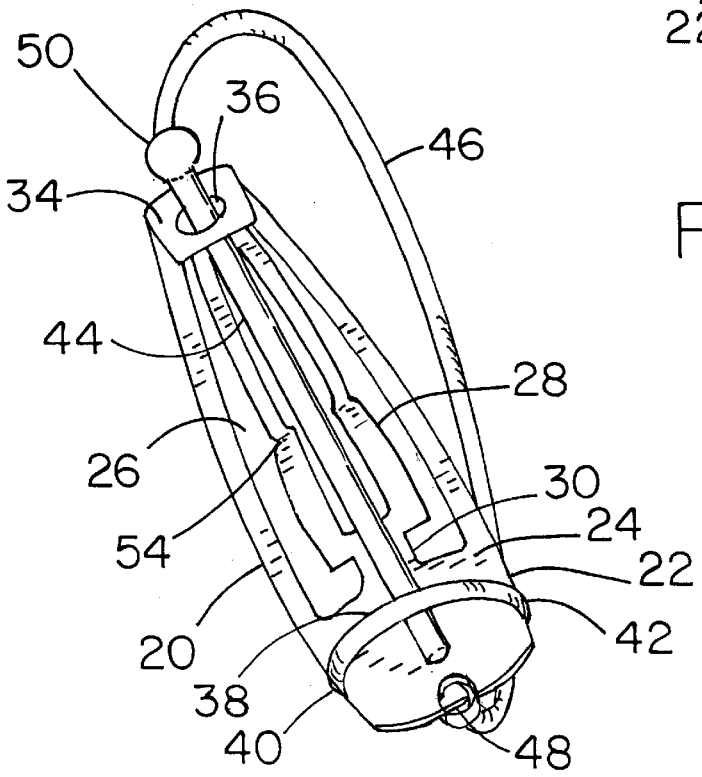
FIG. 2 is a schematic bottom view of the present invention.

With reference now to the drawings, and in particular to FIGS. 1 and 2 thereof, a new hair accessory and binding device embodying the principles and concepts of the present invention and a generally designated by the reference numeral 10 will be described.

As best illustrated in FIGS. 1 and 2, the hair accessory and binding device 10 generally comprises a first panel 12 which is elongated and has a first end edge 14, a second end edge 16, a first side edge 18, a second side edge 20, a top surface 22 and a bottom surface 24. The first panel 12 has an elongate opening 26 therein generally extending from the first end edge 14 to the second end edge 16. The first end edge 14 has a greater width from the first side edge 18 to the second side edge 20 than the width of the second side edge 16 such that the first panel 12 narrows from the first end edge 14 to the second end edge 16.

A second panel 28 is elongated and has a first end 30 and a second end 32. The first end 30 of the second panel 28 is integrally attached to the bottom surface 24 of the first panel 28 and is positioned adjacent to the first end edge 14 such that the second panel 28 is attached to an edge of the opening 26 in the first panel 12. The second panel 28 generally extends toward the first end edge 16 of the first panel 12. Each of the first 12 and second 28 panels is resiliently elastic such that the second panel 28 may be brought in abutment with the first panel 12. The panels 12, 28 preferably tither comprise a plastic material or a thin metallic material.

A tab 34 is attached to the second end edge 16 of the first panel 12 and is angled toward the first end edge 14 such that the tab 34 extends downward with respect to the top surface 22. The tab is angled. The tab 34 has an aperture 36 therein.

A catch 38 has a first end 40 attached to the first side edge 18 and a second end 42 attached to the second side edge 20 such that the catch 38 extends across the bottom surface 22. The catch 38 is 114 positioned generally adjacent to the first end edge 14.

A pin 44 is extendable through the aperture 36 in the tab 34 and through the catch 38 for releasably holding the second panel 28 in abutment against the first panel 12 when hair is placed between the first 12 and second 28 panels.

An elongate flexible member 46 has a first end 48 attached to the first end edge 14 and a second end 50 attached to an end of the pin 44. A plurality of beads 52 is preferably positioned on the elongate flexible member 46.

In use, the hair of a user is placed between the first panel 12 and the second panel 28 to form a ponytail about four inches away from the head of the user. The second end 32 of the second panel 28 is placed between the tab 34 and the first panel 12 such that the second panel is biased against the tab 34. The device is then wrapped in the hair until the device is against the head to form a French roll against the head. The pin 44 is then extended through the aperture 36 and through the catch 38 such that the elongate flexible member 46 is wrapped over the outside of the hair. The hair of the user is thus positioned between the elongate flexible member 46 and the first panel 12 for binding the hair in a taut manner against the head of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair accessory device comprising:

a first panel being elongated and having a first end edge, a second end edge, a first side edge, a second side edge a top surface and a bottom surface;

a second panel being elongated and having a first end and a second end, said first end of said second panel being integrally attached to said bottom surface of said first panel and being positioned adjacent to said first end edge, said second panel generally extending toward said second end edge of said first panel, each of said first and second panels being resiliently elastic such that said second panel may be brought in abutment with said first panel;

a tab being attached to said second end edge of said first panel and being angled toward said first end of said first panel such that said tab extends downward with respect to said top surface, said tab having an aperture therein, wherein said second end of said second panel is placed between said tab and the first panel such that the second panel is biased against the tab and the hair of the user is bound in between the first and second panels;

a catch being attached to said first panel and being positioned generally adjacent to said first end edge;

a pin;

an elongate flexible member having a first end attached to said first end edge and a second end attached to an end of said pin; and wherein the hair is wrapped about the hair between the panels toward the scalp and defining a French roll and said pin may be extended through said aperture in said tab and through said catch such that said elongate flexible member extending around the French roll for securing the French roll taut.

2. The hair accessory device as in claim 1, wherein said first panel has an elongate opening therein generally extending from said first end edge to said second end edge.

3. The hair accessory device as in claim 1, wherein said first end edge has a greater width from said first side edge to said second side edge than the width of said second side edge such that said first panel narrows from said first end edge to said second end edge.

4. The hair accessory device as in claim 2, wherein said second panel is attached to an edge of said opening in said first panel.

5. The hair accessory device as in claim 1, wherein said catch has a first end attached to said first side edge and a second end attached to said second side edge such that said catch extends across said bottom surface.

6. The hair accessory device as in claim 1, further including a plurality of beads being positioned on said elongate flexible member.

7. A hair accessory device comprising:

a first panel being elongated and having a first end edge, a second end edge, a first side edge, a second side edge a top surface and a bottom surface, said first panel having an elongate opening therein generally extending from said first end edge to said second end edge, said first end edge having a greater width from said first side edge to said second side edge than the width of said second side edge such that said first panel narrows from said first end edge to said second end edge;

a second panel being elongated and having a first end and a second end, said first end of said second panel being integrally attached to said bottom surface of said first panel and being positioned adjacent to said first end edge such that said second panel is attached to an edge of said opening in said first panel, said second panel generally extending toward said second end edge of said first panel, each of said first and second panels being resiliently elastic such that said second panel may be brought in abutment with said first panel;

a tab being attached to said second end edge of said first panel and being oriented generally perpendicular to said first panel such that said tab extends downward with respect to said top surface, said tab having an aperture therein;

a catch having a first end attached to said first side edge and a second end attached to said second side edge such that said catch extends across said bottom surface, said catch being positioned generally adjacent to said first end edge;

a pin; and a an elongate flexible member having a first end attached to said first end edge and a second end attached to an end of said pin, a plurality of beads being positioned on said elongate flexible member; and wherein the hair is wrapped about the hair between the panels toward the scalp and defining a French roll and said pin may be extended through said aperture in said tab and through said catch such that said elongate flexible member extending around the French roll for securing the French roll taut.

* * * * *